US008459382B2

(12) United States Patent
Aliko et al.

(10) Patent No.: US 8,459,382 B2
(45) Date of Patent: Jun. 11, 2013

(54) ROTARY DRILL BITS INCLUDING BEARING BLOCKS

(75) Inventors: Enis Aliko, Cepagatti (IT); Thorsten Schwefe, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 198 days.

(21) Appl. No.: 12/901,107

(22) Filed: Oct. 8, 2010

(65) Prior Publication Data

US 2011/0100721 A1 May 5, 2011

Related U.S. Application Data

(63) Continuation of application No. 11/818,820, filed on Jun. 14, 2007, now Pat. No. 7,814,997.

(51) Int. Cl.
*E21B 10/55* (2006.01)

(52) U.S. Cl.
USPC ..... 175/408; 175/426; 175/430; 175/432

(58) Field of Classification Search
USPC ..... 175/430–432, 408, 426
See application file for complete search history.

(56) References Cited

U.S. PATENT DOCUMENTS

| | | | |
|---|---|---|---|
| 1,805,678 | A | 5/1931 | Smith |
| 1,923,487 | A | 8/1933 | Howard |
| 2,198,849 | A | 4/1940 | Waxler |
| 2,563,515 | A | 8/1951 | Brown |
| 2,624,549 | A | 1/1953 | Wallace |
| 2,684,835 | A | 7/1954 | Moore |
| 2,776,817 | A | 1/1957 | Gregory et al. |
| 3,058,535 | A | 10/1962 | Williams, Jr. |
| 3,153,458 | A | 10/1964 | Short |
| 3,303,894 | A | 2/1967 | Varney |
| 3,308,896 | A | 3/1967 | Henderson |
| 3,536,150 | A | 10/1970 | Stebley |
| 3,709,308 | A | 1/1973 | Rowley et al. |
| 3,779,323 | A | 12/1973 | Horten et al. |

(Continued)

FOREIGN PATENT DOCUMENTS

| | | |
|---|---|---|
| EP | 0 169 683 A2 | 1/1986 |
| EP | 0 532 869 B1 | 9/1997 |

(Continued)

OTHER PUBLICATIONS

PCT International Search Report for PCT/US2006/047778 dated Jun. 4, 2007.

(Continued)

*Primary Examiner* — Giovanna Wright
(74) *Attorney, Agent, or Firm* — TraskBritt

(57) ABSTRACT

A bearing block is provided that may be used with a drag bit body or frame to limit depth of cut of cutters on a bit. The bearing block is designed so that it may be interchangeably replaced or repaired without necessitating alteration to a standardized bit frame. The interchangeable bearing block may be used to provide a target depth of cut (TDOC) and/or a selected contact or rubbing area to support weight on bit and limit depth of cut (DOC) for improving drilling performance of a bit. The interchangeable bearing block brings manufacturing selectability by providing a customizable product in terms of depth of cut selection and cutter penetration control for different formations, which is suitable for use with a common bit frame. A rotary drill bit assembly, a unitary cone insert bearing block for a drill bit, and a bit frame are also provided.

52 Claims, 11 Drawing Sheets

U.S. PATENT DOCUMENTS

| | | | |
|---|---|---|---|
| 3,915,246 | A | 10/1975 | Sheshtawy |
| 3,938,599 | A | 2/1976 | Horn |
| 4,006,788 | A | 2/1977 | Garner |
| 4,116,289 | A | 9/1978 | Feenstra |
| 4,176,723 | A | 12/1979 | Arceneaux |
| 4,253,533 | A | 3/1981 | Baker, III |
| 4,351,401 | A | 9/1982 | Fielder |
| 4,386,669 | A | 6/1983 | Evans |
| 4,499,958 | A | 2/1985 | Radtke et al. |
| 4,512,426 | A | 4/1985 | Bidegaray |
| 4,554,986 | A | 11/1985 | Jones |
| 4,718,505 | A | 1/1988 | Fuller |
| 4,763,737 | A | 8/1988 | Hellnick |
| 4,815,342 | A | 3/1989 | Brett et al. |
| 4,889,017 | A | 12/1989 | Fuller et al. |
| 4,932,484 | A | 6/1990 | Warren et al. |
| 4,942,933 | A | 7/1990 | Barr et al. |
| 4,981,184 | A | 1/1991 | Knowlton et al. |
| 4,982,802 | A | 1/1991 | Warren et al. |
| 4,991,670 | A | 2/1991 | Fuller et al. |
| 5,010,789 | A | 4/1991 | Brett et al. |
| 5,033,560 | A | 7/1991 | Sawyer et al. |
| 5,042,596 | A | 8/1991 | Brett et al. |
| 5,090,492 | A | 2/1992 | Keith |
| 5,111,892 | A | 5/1992 | Sinor et al. |
| 5,131,478 | A | 7/1992 | Brett et al. |
| 5,199,511 | A | 4/1993 | Tibbitts et al. |
| 5,222,566 | A | 6/1993 | Taylor et al. |
| 5,244,039 | A | 9/1993 | Newton, Jr. et al. |
| 5,265,685 | A | 11/1993 | Keith et al. |
| 5,303,785 | A | 4/1994 | Duke |
| 5,314,033 | A | 5/1994 | Tibbitts |
| 5,388,649 | A | 2/1995 | Ilomaki |
| 5,402,856 | A | 4/1995 | Warren et al. |
| 5,433,280 | A | 7/1995 | Smith |
| 5,437,343 | A | 8/1995 | Cooley et al. |
| 5,447,208 | A | 9/1995 | Lund et al. |
| 5,505,273 | A | 4/1996 | Azar et al. |
| 5,531,281 | A | 7/1996 | Murdock |
| 5,544,550 | A | 8/1996 | Smith |
| 5,549,171 | A | 8/1996 | Mensa-Wilmot et al. |
| 5,558,170 | A | 9/1996 | Thigpen et al. |
| 5,582,258 | A | 12/1996 | Tibbitts et al. |
| 5,595,252 | A | 1/1997 | O'Hanlon |
| 5,607,025 | A | 3/1997 | Mensa-Wilmot et al. |
| 5,651,421 | A | 7/1997 | Newton et al. |
| 5,653,300 | A | 8/1997 | Lund et al. |
| 5,663,512 | A | 9/1997 | Schader et al. |
| 5,720,357 | A | 2/1998 | Fuller et al. |
| 5,730,234 | A | 3/1998 | Putot |
| 5,738,178 | A | 4/1998 | Williams et al. |
| 5,839,329 | A | 11/1998 | Smith et al. |
| 5,873,422 | A | 2/1999 | Hansen et al. |
| 5,937,958 | A | 8/1999 | Mensa-Wilmot et al. |
| 5,957,006 | A | 9/1999 | Smith |
| 5,979,576 | A | 11/1999 | Hansen et al. |
| 6,073,518 | A | 6/2000 | Chow et al. |
| 6,089,123 | A | 7/2000 | Chow et al. |
| 6,123,161 | A | 9/2000 | Taylor |
| 6,142,250 | A | 11/2000 | Griffin et al. |
| 6,200,514 | B1 | 3/2001 | Meister |
| 6,209,420 | B1 | 4/2001 | Butcher et al. |
| 6,246,974 | B1 | 6/2001 | Jelley et al. |
| 6,298,930 | B1 | 10/2001 | Sinor et al. |
| 6,321,862 | B1 | 11/2001 | Beuershausen et al. |
| 6,408,958 | B1 | 6/2002 | Isbell et al. |
| 6,427,792 | B1 | 8/2002 | Roberts et al. |
| 6,450,271 | B1 | 9/2002 | Tibbitts et al. |
| 6,460,631 | B2 | 10/2002 | Dykstra et al. |
| 6,568,492 | B2 | 5/2003 | Thigpen et al. |
| 6,575,256 | B1 | 6/2003 | Doster |
| 6,581,671 | B2 | 6/2003 | Butcher et al. |
| 6,659,199 | B2 | 12/2003 | Swadi |
| 6,779,613 | B2 | 8/2004 | Dykstra et al. |
| 6,823,952 | B1 | 11/2004 | Mensa-Wilmot et al. |
| 6,883,623 | B2 | 4/2005 | McCormick et al. |
| 6,904,983 | B2 | 6/2005 | Thigpen et al. |
| 6,935,441 | B2 | 8/2005 | Dykstra et al. |
| 7,237,628 | B2 | 7/2007 | Desai et al. |
| 7,360,608 | B2 | 4/2008 | Brackin et al. |
| 7,395,882 | B2 | 7/2008 | Oldham et al. |
| 7,413,032 | B2 | 8/2008 | Krueger |
| 7,814,990 | B2 | 10/2010 | Dykstra et al. |
| 7,814,997 | B2 | 10/2010 | Aliko et al. |
| 2001/0030065 | A1 | 10/2001 | Beuershausen et al. |
| 2004/0244540 | A1 | 12/2004 | Oldham et al. |
| 2004/0245022 | A1 | 12/2004 | Izaguirre et al. |
| 2004/0245024 | A1 | 12/2004 | Kembaiyan |
| 2005/0211475 | A1 | 9/2005 | Mirchandani et al. |
| 2005/0230150 | A1 | 10/2005 | Oldham et al. |
| 2007/0017710 | A1 | 1/2007 | Achilles et al. |
| 2007/0151770 | A1 | 7/2007 | Ganz |
| 2008/0308321 | A1 | 12/2008 | Aliko et al. |
| 2010/0276200 | A1 | 11/2010 | Schwefe et al. |
| 2011/0114392 | A1 | 5/2011 | Dykstra et al. |

FOREIGN PATENT DOCUMENTS

| | | | |
|---|---|---|---|
| EP | 0 874 128 | A2 | 10/1998 |
| EP | 0 822 318 | B1 | 6/2002 |
| EP | 1 236 861 | A | 9/2002 |
| GB | 2 190 120 | B1 | 11/1987 |
| GB | 2 273 946 | A | 7/1994 |
| GB | 2 326 659 | A | 12/1998 |
| GB | 2 329 203 | A | 3/1999 |
| GB | 2 370 592 | A | 7/2002 |

OTHER PUBLICATIONS

1995 Hughes Christensen Drill Bit Catalog, p. 31.

Hughes Christensen Bit Drawing dated May 29, 1997—HC Part No. CC201918.

Hughes Christensen Bit Drawing dated Sep. 18, 1996—HC Part No. CW 210655.

Hughes Christensen Bit Drawing dated Sep. 18, 1996—HC Part No. CS205023.

Hughes Christensen Bit Drawing dated Sep. 9, 1996—HC Part No. CC201718.

Search Report of the UK Patent Office, dated Dec. 7, 2000, for Application No. GB0020134.3.

Search Report of the Belgian Patent Office, dated Aug. 14, 2001, for Application No. BE20000528.

Smith Diamond Drill Bit brochure, bit type M-21 IADC M646, 2 pages, circa 1990's.

Maurer, William C., Advanced Drilling Techniques, 1980, pp. 541 and 568, The Petroleum Publishing Company, Tulsa, Oklahoma.

Fabian, Robert T., Confined compressive strength analysis can improve PDC bit selection, Oil & Gas Journal, May 16, 1994, 5 pages.

Taylor, M.R., et al., High Penetration Rates and Extended Bit Life Through Revolutionary Hydraulic and Mechanical Design in PDC Drill Bit Development, SPE 36435, presented at the SPE Annual Technical Conference and Exhibition, held in Denver, Colorado, Oct. 6-9, 1996, 14 pages.

Spaar, J.R., et al., Formation Compressive Strength Estimates for Predicting Drillability and PDC Bit Selection, SPE/IADC 29397, presented at the SPE/IADC Drilling Conference held in Amsterdam, Feb. 29-Mar. 2, 1995.

Williams, J.L., et al., An Analysis of the Performance of PDC Hybrid Drill Bits, SPE/IADC 16117, presented at the SPE/IADC Drilling Conference, held in New Orleans, LA, on Mar. 15-18, 1987.

Drill Bit Developments, The Institution of Mechanical Engineers, Offshore Engineering Group, seminar held Apr. 26, 1989, in Aberdeen, Scotland.

Counterclaim-Defendants' Amended Invalidity Contentions Pursuant to Patent Rule 3-3, signed by James A. Jorgensen, Feb. 8, 2008, Filed in Civil Action No. 6:06-CV-222 (LED) in the United Stated District Court for the Eastern District of Texas, Tyler Division, 19 pages (nonmaterial portions redacted).

Christensen Diamond Compact Bit Manual, 1982, 89 pages.

Expert Report of MExpert Report of Mark E. Nussbaum, Dated Jan. 7, 2008, Filed in Civil Action No. 6:06-CV-222 (LED) in the United Stated District Court for the Eastern District of Texas, Tyler Division, 57 pages (nonmaterial portions redacted)ark E. Nussbaum, Dated Jan. 7, 2008, Filed in Civil Action No. 6:06-CV-222 (LED) in the United Stated District Court for the Eastern District of Texas, Tyler Division, 57 pages (nonmaterial portions redacted).
Plaintiffs' First Amended Reply to Baker Hughes Oilfield Operations, Inc.'s and Baker Hughes, Inc.'s First Amended Answer and Counterclaims and Plaintiffs' Counterclaims for Declaratory Judgment of Patent Invalidity, Non-Infringement, and Unenforceability, Signed by J. Mike Amerson, dated Feb. 23, 2007, filed in Civil Action No. 6:06-CV-222 (LED) in the United Stated District Court for the Eastern District of Texas, Tyler Division, 11 pages (nonmaterial portions redacted).
Baker Hughes' Use of a Drill Bit Embodying the Alleged Inventions of the Asserted Claims of the 930 Patent Prior to Aug. 26, 1998, Expert Report of Mark Thompson, Jan. 18, 2008, Filed in Civil Action No. 6:06-CV-222 (LED) in the United Stated District Court for the Eastern District of Texas, Tyler Division, 5 pages (nonmaterial portions redacted).
DOCC bit—surface test, Memorandum from Wayne Hansen, dated May 11, 1998, 2 pages, Proprietary Material Subject to Protective Order—Document Filed Separately by Express Mail on Aug. 20, 2008, Pursuant to M.P.E.P. Section 724 With Petition Unde R 37 CFR Section 1.59.
Hansen, Wayne, Depth of Cut Control Feature Phase I 81/2" G554A2, May 1998, 35 pages, Proprietary Material Subject to Protective Order—Document Filed Separately by Express Mail on Aug. 20, 2008, Pursuant to M.P.E.P. Section 724 With Petition Unde R 37 CFR Section 1.59.
Stipulated Motion for Dismissal With Prejudice, United States District Court for the Easter District of Texas, Tyler Division, Civil Action No. 6:06-cv-222 (LED), dated Jun. 25, 2008.
Order Re: Stipulated Motion for Dismissal With Prejudice, United States District Court for the Easter District of Texas, Tyler Division, Civil Action No. 6:06-cv-222 (LED), dated Jun. 26, 2008.
International Search Report for International Application No. PCT/US2008/066947, mailed Mar. 11, 2008, 4 pages.
International Search Report for International Application No. PCT/US2010/032370, mailed Jan. 3, 2011, 3 pages.
International Written Opinion for International Application No. PCT/US2010/032370, mailed Jan. 3, 2011, 3 pages.

ROTARY DRILL BITS INCLUDING BEARING BLOCKS

CROSS-REFERENCE TO RELATED APPLICATION

This application is a continuation of U.S. patent application Ser. No. 11/818,820, filed Jun. 14, 2007, now U.S. Pat. No. 7,814,997 issued on Oct. 19, 2010, the disclosure of which is hereby incorporated herein by this reference in its entirety.

FIELD OF THE INVENTION

The present invention, in several embodiments, relates generally to a rotary fixed cutter or "drag" drill bit employing superabrasive cutters for drilling subterranean formations and, more particularly, to interchangeable bearing blocks useable in association with superabrasive cutters that provide improved accuracy for obtaining a target depth of cut for the cutters or a controlled bearing area on the face of the bit. A drill bit frame for receiving one or more interchangeable bearing blocks is also provided.

BACKGROUND OF RELATED ART

Rotary drag bits employing superabrasive cutting elements in the form of polycrystalline diamond compact (PDC) cutters have been employed for several decades. PDC cutters are typically comprised of a disc-shaped diamond "table" formed on and bonded under high-pressure and high-temperature conditions to a supporting substrate such as cemented tungsten carbide (WC), although other configurations are known. Bits carrying PDC cutters, which for example, may be brazed into pockets in the bit face, pockets in blades extending from the face, or mounted to studs inserted into the bit body, have proven very effective in achieving high rates of penetration (ROP) in drilling subterranean formations exhibiting low to medium compressive strengths. Recent improvements in the design of hydraulic flow regimes about the face of bits, cutter design, and drilling fluid formulation have reduced prior, notable tendencies of such bits to "ball" by increasing the volume of formation material which may be cut before exceeding the ability of the bit and its associated drilling fluid flow to clear the formation cuttings from the bit face.

Even in view of such improvements, however, PDC cutters still suffer from what might simply be termed "overloading" even at low weight-on-bit (WOB) applied to the drill string to which the bit carrying such cutters is mounted, especially if aggressive cutting structures are employed. The relationship of torque to WOB may be employed as an indicator of aggressivity for cutters, so the higher the torque to WOB ratio, the more aggressive the bit. The problem of excessive bit aggressiveness is particularly significant in low compressive strength formations where an unduly great depth of cut (DOC) may be achieved at extremely low WOB. The problem may also be aggravated by drill string bounce, wherein the elasticity of the drill string may cause erratic application of WOB to the drill bit, with consequent overloading. Moreover, operating PDC cutters at an excessively high DOC may generate more formation cuttings than can be consistently cleared from the bit face and back up the bore hole via the junk slots on the face of the bit by even the aforementioned improved, state-of-the-art bit hydraulics, leading to the aforementioned bit balling phenomenon.

Another, separate problem involves drilling from a zone or stratum of higher formation compressive strength to a "softer" zone of lower compressive strength. As the bit drills into the softer formation without changing the applied WOB (or before the WOB can be reduced by the driller), the penetration of the PDC cutters, and thus the resulting torque on the bit (TOB), increase almost instantaneously and by a substantial magnitude. The abruptly higher torque, in turn, may cause damage to the cutters and/or the bit body itself. In directional drilling, such a change causes the tool face orientation of the directional (measuring-while-drilling, or MWD, or a steering tool) assembly to fluctuate, making it more difficult for the directional driller to follow the planned directional path for the bit. Thus, it may be necessary for the directional driller to back off the bit from the bottom of the borehole to reset or reorient the tool face. In addition, a downhole motor, such as drilling fluid-driven Moineau-type motors commonly employed in directional drilling operations in combination with a steerable bottomhole assembly, may completely stall under a sudden torque increase. That is, the bit may stop rotating, thereby stopping the drilling operation and again necessitating backing off the bit from the borehole bottom to re-establish drilling fluid flow and motor output. Such interruptions in the drilling of a well can be time consuming and quite costly.

Numerous attempts using varying approaches have been made over the years to protect the integrity of diamond cutters and their mounting structures and to limit cutter penetration into a formation being drilled. For example, from a period even before the advent of commercial use of PDC cutters, U.S. Pat. No. 3,709,308 discloses the use of trailing, round natural diamonds on the bit body to limit the penetration of cubic diamonds employed to cut a formation. U.S. Pat. No. 4,351,401 discloses the use of surface set natural diamonds at or near the gage of the bit as penetration limiters to control the depth-of-cut of PDC cutters on the bit face. The following other patents disclose the use of a variety of structures immediately trailing PDC cutters (with respect to the intended direction of bit rotation) to protect the cutters or their mounting structures: U.S. Pat. Nos. 4,889,017; 4,991,670; 5,244,039 and 5,303,785. U.S. Pat. No. 5,314,033 discloses, inter alia, the use of cooperating positive and negative or neutral backrake cutters to limit penetration of the positive rake cutters into the formation. Another approach to limiting cutting element penetration is to employ structures or features on the bit body rotationally preceding (rather than trailing) PDC cutters, as disclosed in U.S. Pat. Nos. 3,153,458; 4,554,986; 5,199,511 and 5,595,252.

In another context, that of so-called "anti-whirl" drilling structures, it has been asserted in U.S. Pat. No. 5,402,856 that a bearing surface aligned with a resultant radial force generated by an anti-whirl underreamer should be sized so that force per area applied to the borehole sidewall will not exceed the compressive strength of the formation being underreamed. See also U.S. Pat. Nos. 4,982,802; 5,010,789; 5,042,596; 5,111,892 and 5,131,478.

While some of the foregoing patents recognize the desirability to limit cutter penetration, or DOC, or otherwise limit forces applied to a borehole surface, the disclosed approaches are somewhat generalized in nature and fail to accommodate or implement an engineered approach to achieving a target ROP in combination with more stable, predictable bit performance. Furthermore, the disclosed approaches do not provide a bit or method of drilling which is generally tolerant to being axially loaded with an amount of weight-on-bit over and in excess what would be optimum for the current rate-of-penetration for the particular formation being drilled and which would not generate high amounts of potentially bit-stopping or bit-damaging torque-on-bit should the bit nonetheless be subjected to such excessive amounts of weight-on-bit.

Various successful solutions to the problem of excessive cutter penetration are presented in U.S. Pat. Nos. 6,298,930; 6,460,631; 6,779,613 and 6,935,441, the disclosure of each of which is incorporated by reference in its entirety herein. Specifically, U.S. Pat. No. 6,298,930 describes a rotary drag bit including exterior features to control the depth of cut by cutters mounted thereon, so as to control the volume of formation material cut per bit rotation as well as the torque experienced by the bit and an associated bottom-hole assembly. These features, also termed depth of cut control (DOCC) features, provide the bearing surface or sufficient surface area to withstand the axial or longitudinal WOB without exceeding the compressive strength of the formation being drilled and such that the depth of penetration of PDC cutters cutting into the formation is controlled. Because the DOCC features are subject to the applied WOB as well as to contact with the abrasive formation and abrasives-laden drilling fluids, the DOCC features may be layered onto the surface of a steel body bit as an appliqué or hard face weld having the material characteristics required for a high load and high abrasion/erosion environment, or include individual, discrete wear resistant elements or inserts set in bearing surfaces cast in the face of a matrix-type bit, as depicted in FIG. 1 of U.S. Pat. No. 6,298,930. The wear resistant inserts or elements may comprise tungsten carbide bricks or discs, diamond grit, diamond film, natural or synthetic diamond (PDC or TSP), or cubic boron nitride.

FIGS. 10A and 10B of the '930 patent, respectively, depict different DOCC feature and PDC cutter combinations. In each instance, a single PDC cutter is secured to a combined cutter carrier and DOC limiter, the carrier then being received within a cavity in the face (or on a blade) of a bit and secured therein. The DOC limiter includes a protrusion exhibiting a bearing surface.

While the DOCC features are extremely advantageous for limiting a depth of cut while managing a given WOB, the manufacture of the depth of cut control features upon the bit requires: 1) labor intensive manufacturing to necessarily obtain the precise or desired amount of layered hard facing required for a particular or designed target depth of cut (TDOC) or 2) complicated manufacturing processes to form the bit body in order to assemble and secure each combined cutter carrier having a single PDC cutter and associated DOC limiter placed into a cavity in the face or on a blade of the bit body. Moreover, the foregoing patents do not provide a bit wherein the TDOC and the designed bearing (which may also be termed "rubbing") surface area, i.e., potential contact area with the "to be" drilled subterranean formation, are simultaneously provided for in a structure selectively attachable to a given bit frame, in order to provide variety and selectability of the TDOC and the designed rubbing surface area with a high degree of precision for the given bit frame.

Moreover, many steel body PDC bits are manufactured by cutting the whole blade profile and, in some instances, an entire bit body including the blades, from a material, such as a steel or other casting, with cutter pockets milled into the blades, which are assembled to obtain the bit body or frame, which is then selectively manually hardfaced to create an abrasion-resistant layer for a bearing or rubbing surface. The hardfacing invariably has a tolerance that is either below the amount required for reduced exposure or beyond the amount required for DOCC features. Also, the hardfacing does not provide a precise or controlled rubbing surface area. Further, the hardfacing is permanent as applied and requires grinding in order to remove or modify its thickness when applied beyond an acceptable tolerance.

While matrix body bits are formed by machining features into a mold and provide other features using so-called displacements which are inserted into the mold cavity, achieving precise exposure for cutters within the cone of such a bit body may be difficult due to the angular orientation of the required machining, as well as variances attributable to warpage and shrinkage of the bit body during cooling after infiltration with a molten metal alloy binder. Relatively larger bit bodies may exhibit more variance from the intended dimensions.

Accordingly, it is desirable to provide a bit that eliminates the manufacturing uncertainty or complexity required in obtaining a given TDOC. Also, it is desirable to provide a bit that allows for a selectable bearing or rubbing surface area without, or not requiring, alteration to the bit frame. Moreover, it is desirable to provide TDOC and/or rubbing surface area selectabilty for a given bit frame, providing for inventory reduction of bit frames and allowing for less complicated refabrication or repair of the drill bit to achieve a different TDOC and/or rubbing surface area. Further, it is desirable on steel body bits to achieve an extremely accurate TDOC and/or rubbing surface area while allowing manufacture of bits, i.e., their bit frames, with more accuracy than otherwise provided by hardfacing, in order to provide increased precision of cutter exposure and controlled rubbing area thereof. Furthermore, in providing for the selectability of the rubbing surface area and thickness, it is desirable to provide designed abrasion resistance to enhance the bit's life by limiting, i.e., controlling, wear caused by rubbing surface contact during drilling. Finally, it is desirable to provide the above desired improvements affording increased reparability, inventory flexibility (leading to inventory reduction), and design rationalization of steel body bits as well as matrix body bits.

BRIEF SUMMARY OF THE INVENTION

In accordance with a first embodiment of the invention, an interchangeable bearing block comprising at least an abrasion- and erosion-resistant rubbing surface for use with a PDC drill bit. The block may be configured to provide a specified TDOC upon a bit body, which may also be characterized as a bit "frame," in order to minimize manufacturing tolerance uncertainty and reduce the complexity in obtaining a TDOC otherwise associated with conventional drill bit fabrication techniques. Also, the block enables selection of a bearing or rubbing surface area without necessitating alteration to the bit frame of a drill bit. Moreover, the block allows for different TDOCs and/or rubbing surface areas to be selectively chosen for a given bit frame to accommodate formations exhibiting a substantial variance in compressive strengths, reducing required inventory count for bits and further facilitating re-fabrication in order to provide a different TDOC and/or rubbing surface area on a given bit. Further, the block increases precision of cutter exposure and rubbing area by eliminating manufacturing sensitivities associated with the use of hardfacing to provide a controlled cutter exposure. Furthermore, the block may include or be surfaced with abrasion-resistant materials to enhance the life of the bit. In addition, by providing a block having modifiable attributes that is selectively attachable to a given bit frame, reparability of a bit frame improves and inventory flexibility increases by enabling improved design rationalization without necessitating modification to a bit frame configuration.

In another embodiment of the invention, a cutter block is provided that includes a precise, wear-resistant bearing or rubbing area, the block being interchangeably attachable to a standardized bit or bit frame. The block provides a bearing or rubbing area specifically tailored to withstand axial or longitudinal WOB loading of the bit, by supporting, without exceeding, the compressive strength of a selected formation being drilled.

A further embodiment of the invention includes a bearing block having a precision TDOC, which may be characterized as the distance between the outermost (cutting) edges of the PDC cutters associated with the block and the rubbing surface of the block. Resultantly, the cutter block, when inserted into a receptacle on the face of a drill bit body or frame, defines the TDOC for the plurality of associated cutters. Accordingly, providing a discrete, separately fabricated block offering a precise TDOC and/or bearing rubbing area, allows the block to be fabricated without modification of the bit body.

In some embodiments, the bearing block may include a plurality of PDC cutters, disposed in cutter pockets formed on the face of the block. In other embodiments, the bearing block may be disposed in a receptacle on the bit face in association with a plurality of PDC cutters.

Accordingly, a bearing block is provided that may be used with one or more blades of a bit body or frame. The block is designed so that it may be replaced or repaired, typically, without necessitating alteration to a standardized bit frame. The interchangeable block may offer a precise TDOC and/or a bearing or rubbing area for improving drilling performance of a bit. The block may or may not carry cutters; in the latter instance, the receptacle for the block on the bit body is placed in close proximity to those cutters for which DOC is to be controlled by that block, The block may be located substantially in the cone region on a blade of the bit frame, or may also be located in a region bridging the cone and the nose or, optionally, in the nose region. The interchangeable block brings manufacturing selectability by providing a product customizable for use in a variety of subterranean formations and suitable for use with a common bit frame, thus, not requiring a complex assortment of stocked bit frames. Blocks providing different TDOCs and different bearing areas may be selected as desired for insertion into a bit frame, allowing a bit to be customized or adapted for different drilling applications, including different formations, and for use with different drilling systems in terms of power, hydraulic flow and drilling fluids. A single bearing block may provide different TDOCs and more than one bearing or rubbing areas, of different surface areas.

A rotary drill bit assembly including at least one bearing block, a unitary cone insert bearing block for a drill bit and a bit frame for receiving an interchangeable bearing block are also provided.

Other advantages and features of the present invention will become apparent, when viewed in light of the detailed description of the various embodiments of the invention, and when taken in conjunction with the attached drawings and appended claims.

DETAILED DESCRIPTION OF THE INVENTION

Figure 1:
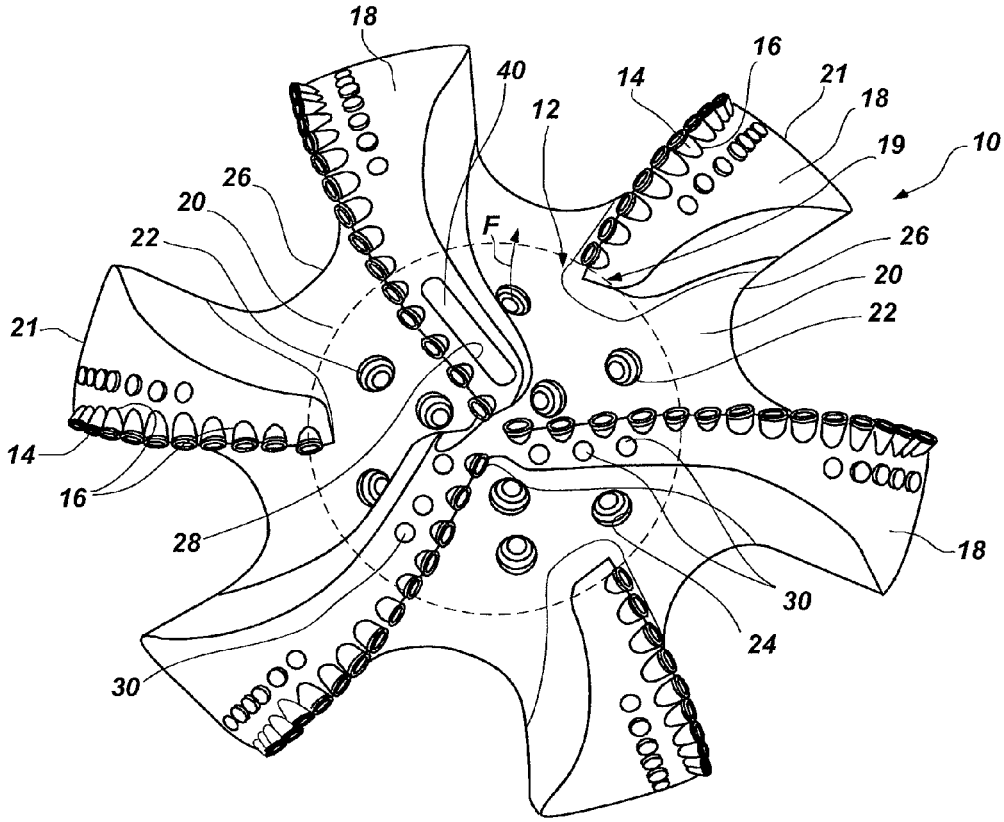
FIG. 1 shows a steel body PDC bit having an attached bearing block in accordance with a first embodiment of the invention.

The first embodiment of the invention is shown in FIGS. 1, 2A, 3A and 4. FIG. 1 shows a steel body drag bit 10 having an attached bearing block 40 as viewed by looking upwardly at its face or leading end 12 as if the viewer was positioned at the bottom of a borehole. Bit 10 includes a plurality of PDC cutters 14 bonded by their substrates (diamond tables and substrates not shown separately for clarity), as by brazing, into pockets 16 in blades 18 extending above the face 12 of the bit 10, as is known in the art with respect to the fabrication of steel body bits. Alternatively, the bit 10 may also be a so-called "matrix" type bit. Such bits include a mass of metal powder, such as tungsten carbide, infiltrated with a molten, subsequently hardenable binder, such as a copper-based alloy, for example the bit frame 110 shown in FIG. 5 as discussed below. It should be understood, however, that the invention is not limited to steel body or matrix-type bits, and bits of other manufacture may also be configured according to embodiments of the invention and employed with bearing blocks thereof.

Fluid courses 20 lie between blades 18 and are provided with drilling fluid by nozzles 22 secured in nozzle orifices 24, nozzle orifices 24 being at the end of passages leading from a plenum extending into the bit body from a tubular shank at the upper, or trailing, end of the bit 10. Fluid courses 20 extend to junk slots 26 extending upwardly along the side of bit 10 between blades 18. Gage pads (not shown) comprise longitudinally upward extensions of blades 18 and may have wear-resistant inserts or coatings on radially outer surfaces 21 thereof as known in the art. Formation cuttings are swept away from PDC cutters 14 by drilling fluid F emanating from nozzle orifices 24 which moves generally radially outwardly through fluid courses 20 and then upwardly through junk slots 26 to an annulus between the drill string from which the bit 10 is suspended and on to the surface.

Figure 2A:
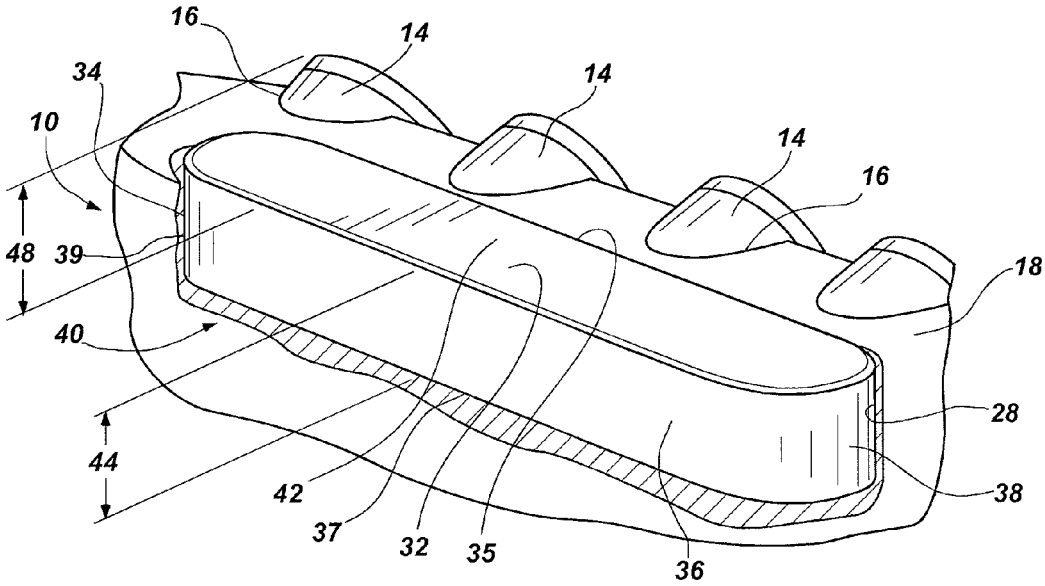
FIG. 2A shows a partial view of the bit exposing the attached bearing block of FIG. 1.
Figure 3A:
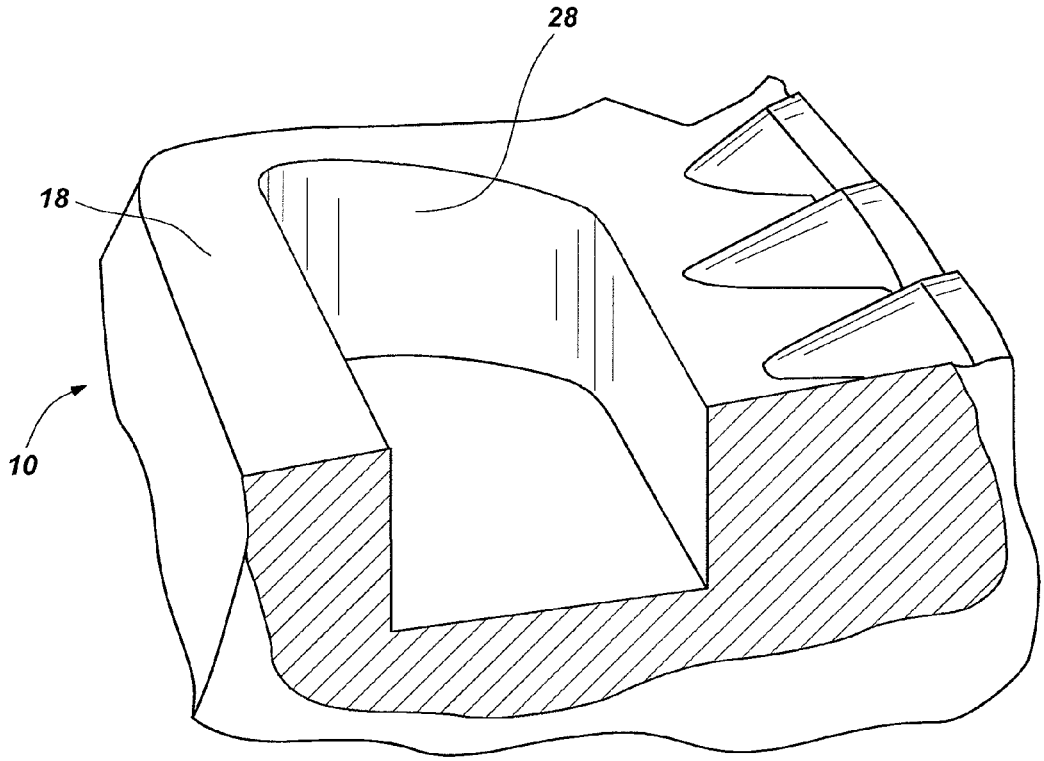
FIG. 3A shows a partial perspective cross-sectional view of the bit having a receptacle for receiving the bearing block in accordance with the first embodiment.

Simultaneous reference may be made to FIGS. 2A and 3A depicting further details of the bit 10 of FIG. 1. FIG. 2A shows a partial view of the bit 10 exposing the attached bearing block 40. FIG. 3A shows a partial perspective cross-sectional view of the bit 10 having a receptacle 28 for receiving the bearing block 40. The receptacle 28 substantially conforms to a portion of the bearing block 40 for receiving and attaching it therein. Moreover, the receptacle 28 has a defined depth in relation to the cutter pockets 16, and ultimately outer, or cutting, edges of the cutters 14. The defined depth of the receptacle 28 is a function of a desired (TDOC) (discussed below), the thickness of bearing block 40 and the desired positioning of the cutters 14 and size of the cutters 14 in the blade 18 of the bit 10 in order to achieve TDOC as understood by a person of ordinary skill in the art and discussed in the references incorporated herein.

The bearing block 40, as shown in FIGS. 1 and 2A may be billet shaped having a bearing or rubbing surface 32 and an interface surface 34, which in this embodiment includes a rotationally (as the bit is rotated during drilling) leading side 35, a rotationally trailing side 36, a bottom 37, and two ends 38, 39. The interface surface 34 of the bearing block 40 is substantially received within and may be attached, by interference fit, to the receptacle 28 of the blade 18. The bearing block 40 may also be bonded or secured by brazing or other attachment methods known to one of ordinary skill in the art. When the bearing block 40 is secured to the blade 18 by bonding (including brazing), the bonding material may also act as a filler to fill any interstitial gaps or voids between the perimeter of receptacle 28 and the bearing block 40 to reduce the potential for damage to the bit face 12 along the blade/block interface by abrasives-laden drilling fluids. The receptacle 28 is located, in this embodiment, generally in the cone region 19 of the blade 18, allowing the bearing block 40 to rotationally trail a plurality of cutters 14. The bearing block 40 may be replaced or exchanged with a block having different characteristics, as discussed below. While this embodiment of the invention provides a single bearing block 40 providing a TDOC for associated four cutters 14 on one blade 18, it is recognized that more than one block may be used to advantage on several of the blades for facilitating TDOC for multiple cutters in a given region or regions (cone, nose, etc.) of the bit face 12. Also, it is recognized that the blade 18 may carry multiple blocks thereon.

It is noted that the word "block" as used to describe the bearing block 40 as given in the first embodiment of the invention, or any other embodiment, is not intended to create or import unintended structural limitations. Specifically, the word "block" is intended to mean piece, portion, part, insert, object, or body, without limitation, all of which have mass and shape, without further limitation to material and/or other physical attributes except as expressly presented herein. Also, while the bearing block 40 in the first embodiment may be described for convenience as a "matrix" bearing block, its material composition is, in this embodiment, a tungsten carbide sintered alloy having particular, desired mechanical features such as improved strength and improved abrasion and erosion resistance as would be recognized by a person of skill in the art. However, other materials may be utilized, alone or in combination, for a block including homogenous or heterogenous block materials, ceramics, materials exhibiting high hardness and abrasion- and erosion-resistant characteristics carried on supporting substrates exhibiting superior toughness and ductility, thermally stable polycrystalline diamond material disposed on a supporting substrate and other carbide materials, for example, without limitation.

The bearing block 40 includes several novel and unobvious aspects. First, the bearing block 40, trailing a plurality of cutters 14, provides a designed bearing or rubbing area 42 affording a surface area specifically tailored to provide support for bit 10 under axial or longitudinal WOB on a selected formation being drilled without exceeding the compressive strength thereof. Second, the bearing block 40 is manufactured, in association with receptacle 28, to provide a precision target depth of cut (TDOC) relating to the distance (thickness) 44 between the bottom 37 and the rubbing surface 32 of the bearing block 40. Resultantly, the bearing block 40, as inserted into the receptacle 28 defines the target depth of cut (TDOC) for the plurality of associated cutters 14, the TDOC being indicated in FIG. 2A by the dimension 48 as measured vertically (with respect to the bit face at a given cutter location) between the outermost cutting edges of cutters 14 and rubbing surface 32 of bearing block 40. Accordingly, a bearing block 40 may have a selected thickness 44 and/or a selected bearing or rubbing area 42, allows the bearing block 40 to be custom tailored to provide desired drilling characteristics for a bit without alteration or modification to the bit body 10.

Tailoring the configuration of the bearing block advantageously provides specifiable TDOC, limiting manufacturing uncertainty as well as reducing complexity of bit production by bringing to the manufacturing process a high precision and easily alterable component, i.e., the block, without altering the base product, i.e., the bit body or frame. Also, the bearing block 40 may be configured to provide for a selectable rubbing surface area not necessitating alteration to the bit body or frame. Moreover, the block enables a variety of TDOCs and/or rubbing surface areas to be selectably chosen for a given bit body or frame, reducing inventory loads for bit frames by enhancing design rationalization and further facilitating refurbishment of a given bit in order to acquire a different TDOC and/or bearing or rubbing surface area by exchanging out and replacing the bearing block. Further, the use of a discrete, separately manufactured bearing block eliminates imprecision associated with hardfacing a steel bit body to provide a DOC limiting feature or complex machining of a bit mold to provide a DOC feature on a matrix bit body face, increasing precision of cutter exposure and desired bearing or rubbing area. Furthermore, the block may be made from or optionally include a facing of an abrasion resistant materials to further enhance the life of the bit Optionally, as can be seen in FIG. 1, wear-resistant elements or inserts 30, in the form of tungsten carbide bricks or discs, diamond grit, diamond film, natural or synthetic diamond (PDC or TSP), or cubic boron nitride, may be added to the exterior bearing surfaces of the blades 18 or within the rubbing area 42 of the bearing block 40 to reduce the abrasive wear typically encountered by contact with the formation being drilled which is further influenced by WOB as the bit 10 rotates under applied torque. In lieu of inserts, the bearing surfaces or rubbing area may be comprised of, or completely covered with, a wear-resistant material such as a mosaic of tungsten carbide bricks or discs, a layer of diamond grit or a diamond film applied, for example, by chemical vapor deposition. The TDOC and the bearing or rubbing area of the block will be explained in more detail below, including additional features and characteristics.

Figure 4:
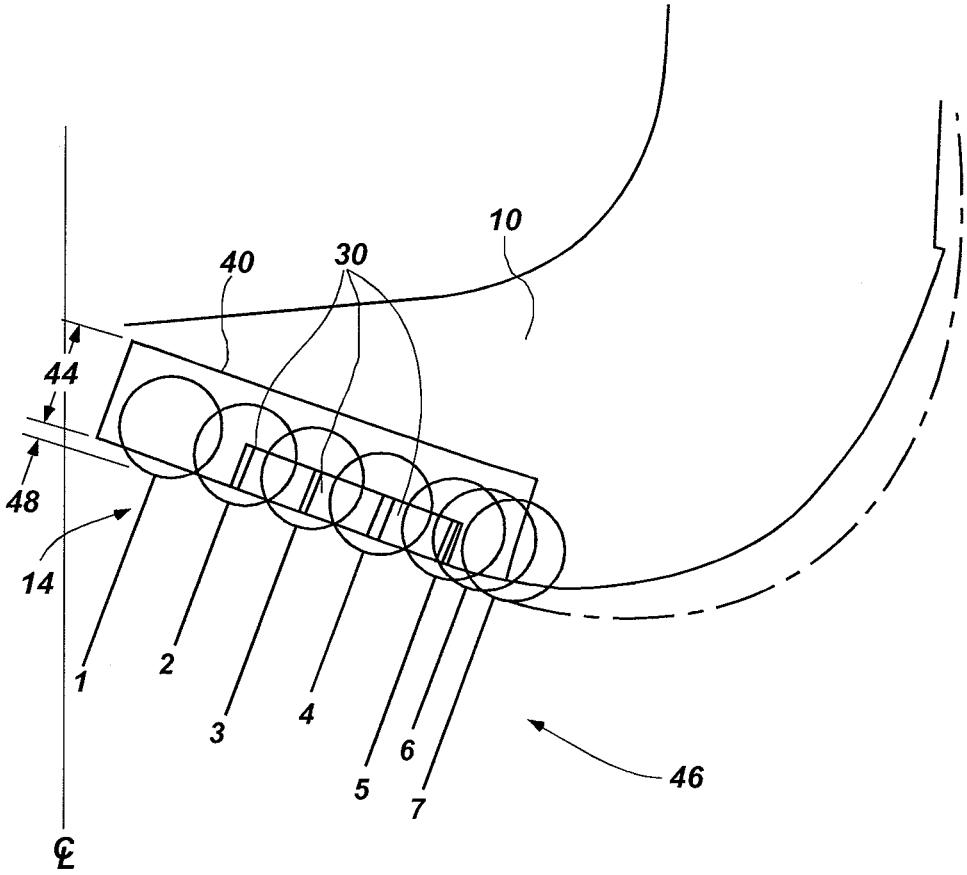
FIG. 4 shows a partial schematic side sectional view illustrating a superimposed cutter profile in accordance with a bearing block of the first embodiment of the invention.

FIG. 4 shows a partial schematic side sectional view illustrating a superimposed cutter profile 46 in accordance with the first embodiment of the invention. The cutter profile 46 shows the thickness 44 of bearing block 40 which, when disposed in the receptacle 28 of the bit 10, provides a target depth of cut (TDOC) 48 for specific cutters 14. Design criteria for TDOC for a given bit size, profile, cutter number, cutter size and cutter exposure is understood by a person having skill in the art, and, thus, reference may be made to the incorporated references for additional information. Also shown in the cutter profile 46, are optional wear-resistant elements or inserts 30 carried on other blades 18 within the bit cone region 19 (FIG. 1).

Figure 2B:
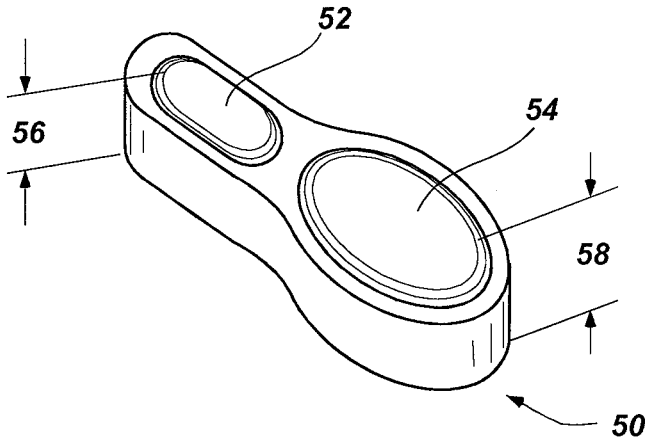
FIG. 2B shows a perspective dramatic view of a "peanut" shaped bearing block in accordance with a second embodiment of the invention.
Figure 2C:
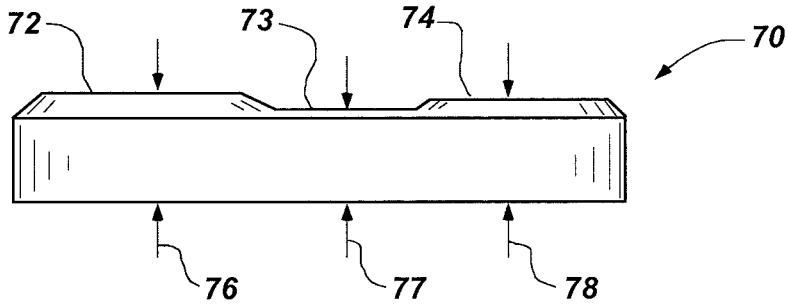
FIG. 2C shows a front leading view of a keyed bearing block in accordance with a third embodiment of the invention.
Figure 2D:
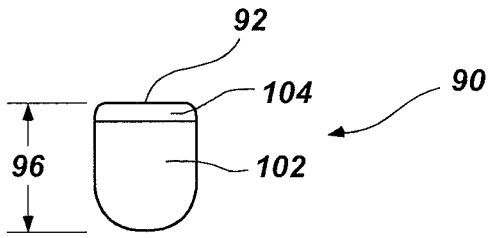
FIG. 2D shows a side view of a low stress "tooth" bearing block in accordance with a fourth embodiment of the invention.
Figure 3B:
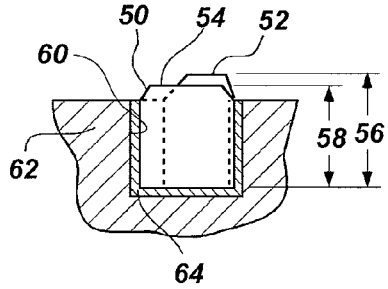
FIG. 3B shows a partial cross-section of a receptacle having the peanut-shaped bearing block disposed therein in accordance with the second embodiment.

Second, third, and fourth embodiments of the invention are shown in FIGS. 2B, 2C, and 2D, and FIGS. 3B, 3C, and 3D, respectively. Turning to FIGS. 2B and 3B, a peanut-shaped bearing block 50 is provided that includes a first rubbing area 52, a second rubbing area 54, a first thickness 56 for first rubbing area 52 and a second thickness 58 for second rubbing area 54. The peanut-shaped bearing block 50 is configured to be received into a complementary socket 60 in a bit blade 62 and brazed 64 thereto. In this embodiment, it is emphasized that the first and second rubbing areas 52 and 54, respectively, may each have different shapes and different rubbing areas for contact with a formation during drilling. Also, the first and second thicknesses 56 and 58, respectively, may be different, as illustrated, allowing the bearing block 50 to be designed specifically for a particular application in order to achieve optimal TDOC for different cutters 14 associated with the bearing block 50. In this aspect, the TDOC may be modified for different applications for a given bit frame or bit body by providing a block having the desired thickness or thicknesses without necessitating modification to the bit frame or bit body. It is also recognized that while the bearing block 50 of this embodiment is "peanut-shaped," as is the complementary socket 60 of a blade 62 (FIG. 3B), that the shape of the bearing block 50 and socket 60 may take on any shape consistent with the capabilities of manufacturing of such structures. Moreover, the peanut-shaped bearing block 50, having different rubbing areas 52, 54 and different thicknesses 56, 58 (and, thus, different TDOCs) may, optionally, provide for a particular or specifiable insertion orientation, as it is to be inserted into the receptacle 60 of the blade 62, beneficially providing an attachment orientation feature for assurance of proper assembly of bearing block 50 with the blade 62. Also, it is recognized that bearing blocks of other shapes may be similarly utilized to advantage.

Figure 3C:
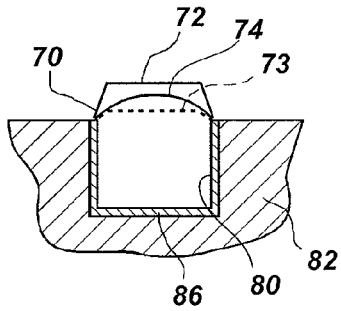
FIG. 3C shows a partial cross-section of a receptacle having the keyed bearing block disposed therein in accordance with the third embodiment.

Turning to FIGS. 2C and 3C, a keyed bearing block 70 includes three different thicknesses 76, 77 and 78 and three different rubbing surfaces 72, 73 and 74, respectively. Generally, the bearing block 70 is "keyed" in the sense of providing two or more thicknesses, each thickness, being associated with one or more adjacent cutters when bearing block 70 is attached to a bit body or frame. Also, the bearing block 70 is "keyed" in that each rubbing surface may exhibit an inclination (tilt) or a complex contour and be specifically tied to the TDOC to be provided a given cutter or cutters, in order to provide a combination of TDOCs within a single bearing block. In the case of an inclined rubbing surface, the angle of inclination may be selected to approximate a helix angle traveled by a cutter as it rotates and travels with the bit at a specific radial location on the bit face when the bit operates at a selected rate of penetration (ROP) or range of ROPs. Accordingly, the bearing block 70 comprises thicknesses 76, 77, 78 having rubbing surface 72 tilted toward its leading side, the rubbing surface 73 that is substantially flat, and the rubbing surface 74 being substantially convex, respectively. By providing complex rubbing surface orientations and thicknesses, the cutters (not shown) of a blade 82 (FIG. 3C) will provide highly precise TDOCs, which may also advantageously allow the bearing block 70 to have one or more advantageous contact levels and orientations with the formation being drilled. Also, in this embodiment the bearing block 70 is secured to a receptacle 80 of the blade 82 with an adhesive cement layer 86.

Figure 3D:
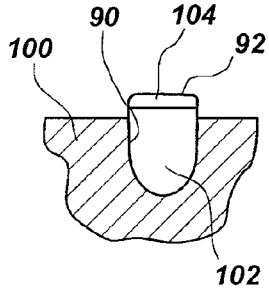
FIG. 3D shows a partial cross-section of a "root" receptacle having the tooth bearing block disposed therein in accordance with the fourth embodiment.

In FIGS. 2D and 3D, a low stress "tooth" bearing block 90 coupled to a "root" receptacle 100 is shown. In this embodiment, the tooth bearing block 90 is press-fit into the root receptacle 100. The low stress design includes a smooth, transition free, interface surface between the tooth bearing block 90 and the root receptacle 100, i.e., there are no high stress inflection points. The tooth bearing block 90 includes a thickness 96 and a rubbing surface 92. The tooth bearing block 90 of this embodiment may be structured as a composite comprising a base material 102 made of tungsten matrix having superior loading strength, and a rubbing surface material 104 comprising an array or mosaic of thermally stable polycrystalline diamonds, or TSPs, (individual diamond not shown) for superior abrasion resistance.

It is intended that the various aspects of the invention described and illustrated with respect to each embodiment of the invention may be utilized together or in any combination to achieve additional benefits within the scope of the invention as claimed.

Interchangeable bearing blocks in accordance with a fifth, sixth and seventh embodiment of the invention are now presented. Generally, before turning specifically to the embodiments that follow, the bearing blocks of the invention may also include one or more cutter pockets. Each cutter pocket is in addition to the bearing block having a designed thickness and/or a designed rubbing area. Each cutter pocket added to the bearing block enables a target depth of cut (TDOC) for the cutters mounted in that block to be determined with respect to the block, instead of being determined conventionally with respect to the blade of a bit body as is known in the art. Also, each bearing block, as described in the embodiments that follow, may be configured to complete the radially inner end of a given blade portion and is located substantially in the cone region, the cone-nose region or the nose region of the bit frame. As mentioned above, bearing blocks having different thicknesses and different rubbing areas may be selectively secured to a common bit frame, thereby reducing inventory demand for bit frames while providing interchangeable bearing blocks to achieve a TDOC when the cutters are mounted thereon.

Figure 5:
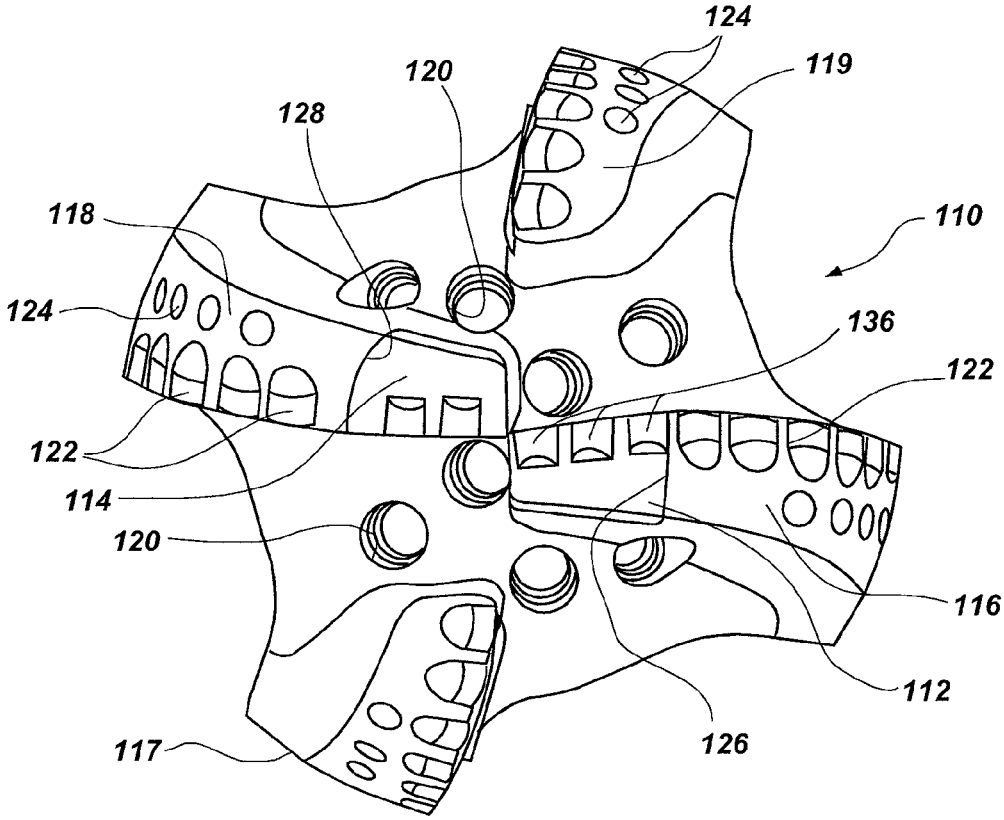
FIG. 5 shows a bit frame for a matrix PDC bit having attached cone blade bearing blocks in accordance with a fifth embodiment of the invention.

Before proceeding to FIG. 5, a bit frame may be characterized by its size, number of blades, the position of each blade, the height contour of each blade and the width contour of each blade as understood by a person of ordinary skill in the subterranean drill bit art. A bit frame, in general terms, is the body support structure from which a PDC bit is fabricated when cutter pockets, cutters, nozzle ports, nozzles, and other features are added thereto.

FIG. 5 shows a bit frame 110 for a matrix body PDC bit, the bit frame 110 including attached cone blade bearing blocks 112, 114 in accordance with a fifth embodiment of the invention. Simultaneous reference may also be made to FIGS. 6 and 7 to further describe embodiments of the invention. The bit frame 110 as depicted in FIG. 5 includes four blades 116, 117, 118, 119, and further includes a plurality of nozzle ports 120, a plurality of cutter pockets 122 and a plurality of insert pockets 124. The blades 116, 118 each include blade pockets 126, 128, respectively (blade pocket 128 shown also in FIG. 6). It is recognized that there may be any suitable number of blades or blade pockets on a given bit frame and are not necessarily limited to four blades 116, 117, 118, 119 and two blade pockets 126, 128, respectively. It is anticipated, although not necessarily required, that the bit frame may be standardized to include a blade pocket on each blade that extends radially inwardly significantly into the cone region of the bit frame, for example, without limitation, as shown in the present embodiment. Further, the bit frame may also be standardized to include a blade pocket in the cone region, the cone-nose region or the nose region of one or more blades.

Figure 6:
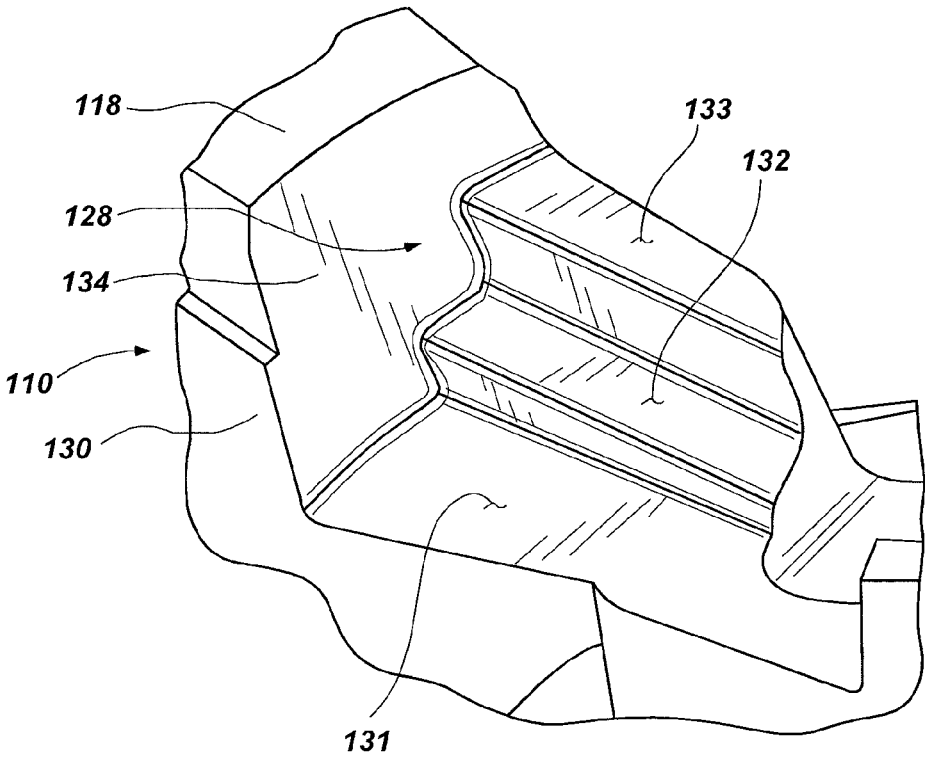
FIG. 6 shows a partial view of a blade of the bit of FIG. 5 having an interface or blade pocket for receiving one of the cone blade bearing blocks in accordance with the fifth embodiment of the invention.

Blade pockets 126, 128 have replaceably attached cone blade bearing blocks 112, 114, respectively. The attachment of cone blade bearing blocks 112, 114 to the blade pockets 126, 128 in the depicted embodiment is by brazing, but the cone blade bearing blocks 112, 114 may be attached by other methods as described herein including, for example, without limitation, adhesives or mechanical fasteners. As shown in FIG. 6, blade pocket 128 is located substantially in a cone end 130 of the blade 118. The blade pocket 128 includes structural pocket support surface in the form of steps 131, 132, 133 and a blade side wall 134. The side wall 134 and pocket steps 131, 132, 133 provide structural support for the cone blade bearing block 114 when attached to the pocket 128. In this embodiment, the side wall 134 is concave for improved adhesion strength when the cone blade bearing block 114 is brazed thereto, and the pocket steps 131, 132, 133 provide increased surface area to improve attachment strength of a cone blade bearing block 114 and also impart additional structural strength to the blade 118, particularly when the cone blade bearing block 114 is subjected to WOB and torque and impact loads experienced by a drag bit during drilling. It is recognized that the side wall 134 may optionally have any other shape or surface contour. Also, the pocket support surface, depicted as comprising steps 131, 132, 133 may optionally have any other suitable surface shape including, for example, a ramped surface or a curved surface, without limitation, such that the attached cone blade bearing block 114 is securely supported when subjected to typical loads experienced during drilling.

Figure 7:
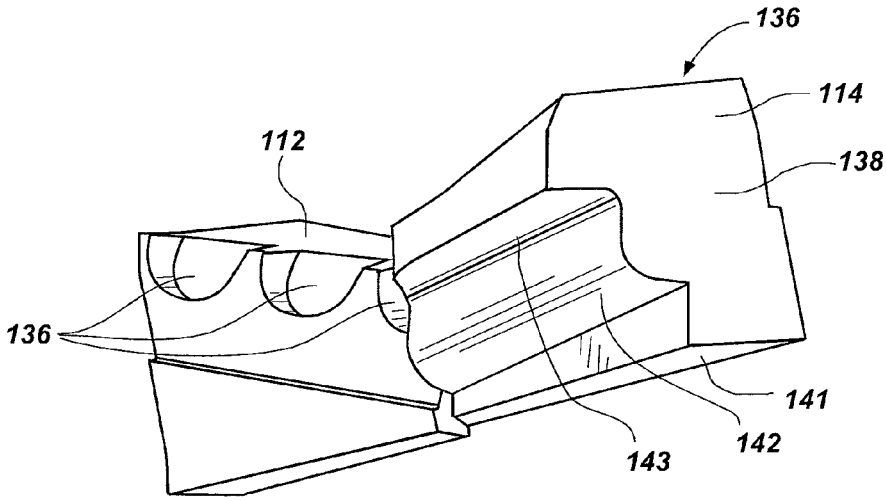
FIG. 7 shows a perspective front view of a first cone blade bearing block and a perspective back view of a second cone blade bearing block in accordance with the fifth embodiment of the invention.

Referring to FIG. 7, the cone blade bearing blocks 112, 114 complete the blades 116, 118 of the bit frame 110 when attached to the blade pockets 126, 128, respectively. Cone blade bearing block 114 includes a block side wall 138 and block surface or steps 141, 142, 143 corresponding in configuration to pocket side wall 134 and pocket steps 131, 132, 133, respectively, for attachment into the blade pocket 128. It is recognized that the block side wall 138 and block surface or steps 141, 142, 143, may have any suitable shape or contacting surface for complementary attachment with a blade pocket in accordance with the invention.

Each cone blade bearing block 112 and 114 includes a plurality of precisely located and oriented cutter pockets 136 for receiving cutters (not shown), thereby allowing for a precise TDOC to be obtained in the customized cone blade bearing block without alteration to the bit frame 110. It is recognized that selection of cutter size, in combination with placement and orientation of cutters with respect to a reference (bearing) surface in order to achieve target depth of cut is understood by one of ordinary skill in the art and does not require further elaboration with respect to each blade bearing block. What has not been previously recognized in the art, however, is the manner in which the invention brings to the art a new way in which TDOC may be altered for a bladed bit without modification to the bit frame. Accordingly, each blade bearing block may be custom-fabricated to achieve a precise TDOC or TDOCs, and rubbing surface area or areas in accordance with the invention as described above, including combinations thereof.

Figure 8:
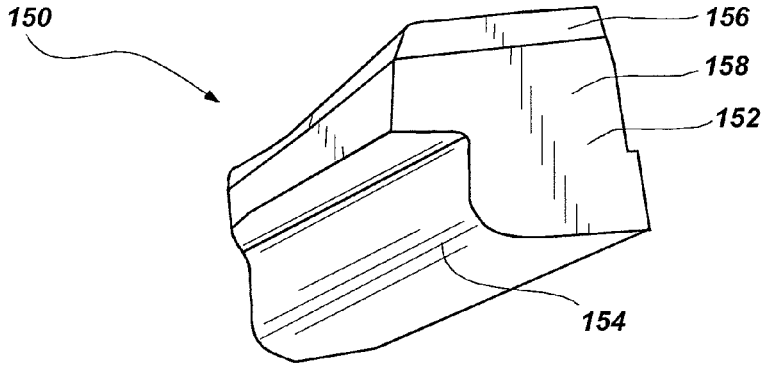
FIG. 8 shows a perspective back view of a cone blade bearing block in accordance with a sixth embodiment of the invention.

FIG. 8 shows a perspective back view of another cone blade bearing block 150 in accordance with a sixth embodiment of the invention. The cone blade bearing block 150 includes a block side wall 152 that is flat, and a support surface 154 that is stepped or tiered, providing connection support when coupled to a complementarily configured bit frame. Also, the cone blade bearing block 150 is a two layer composite having a TSP layer 156 (individual diamonds not depicted) and a tungsten carbide support layer 158 for the benefits described herein. Optionally, the layers 156 and 158 may include other suitable material combinations.

Figure 9:
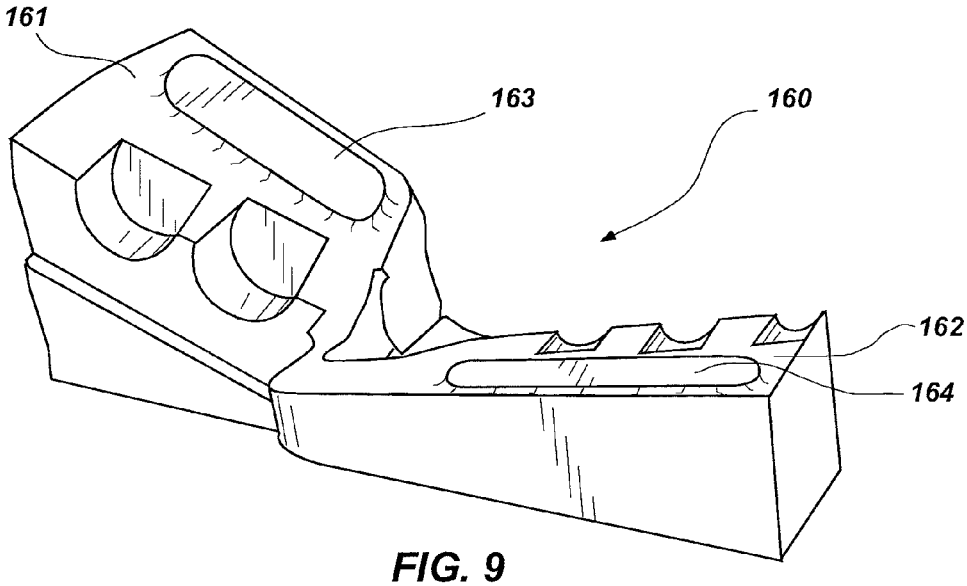
FIG. 9 shows a perspective view of a unitary insert bearing block including two blade portions in accordance with a seventh embodiment of the invention.
Figure 10A:
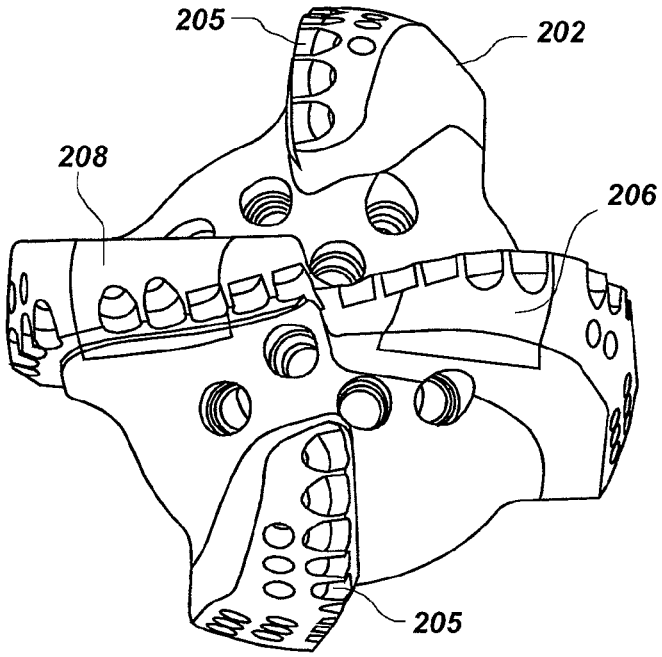
FIGS. 10A-10D show various views of a bit frame of a PDC bit having bearing blocks, blade pockets, cutters and cutter pockets, and bearing blocks having cutters and cutter pockets in accordance with an eighth embodiment of the invention.
Figure 10B:
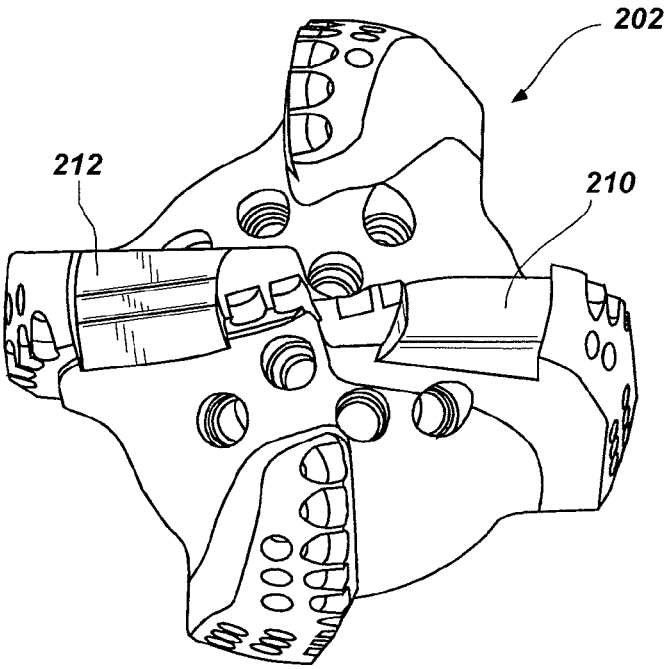
Figure 10C:
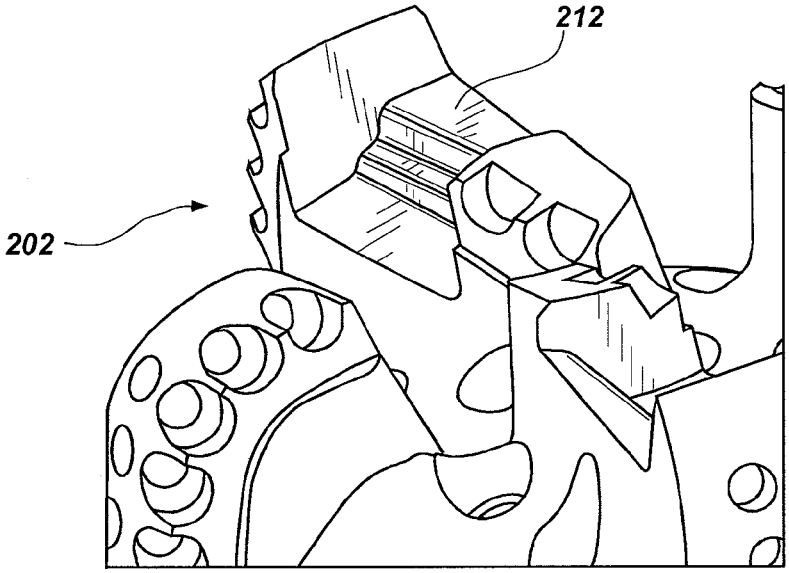
Figure 10D:
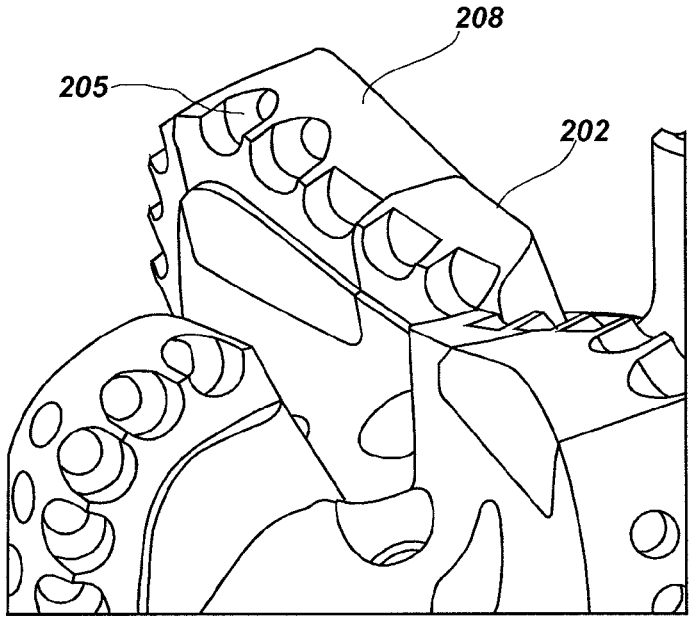
Figure 10E:
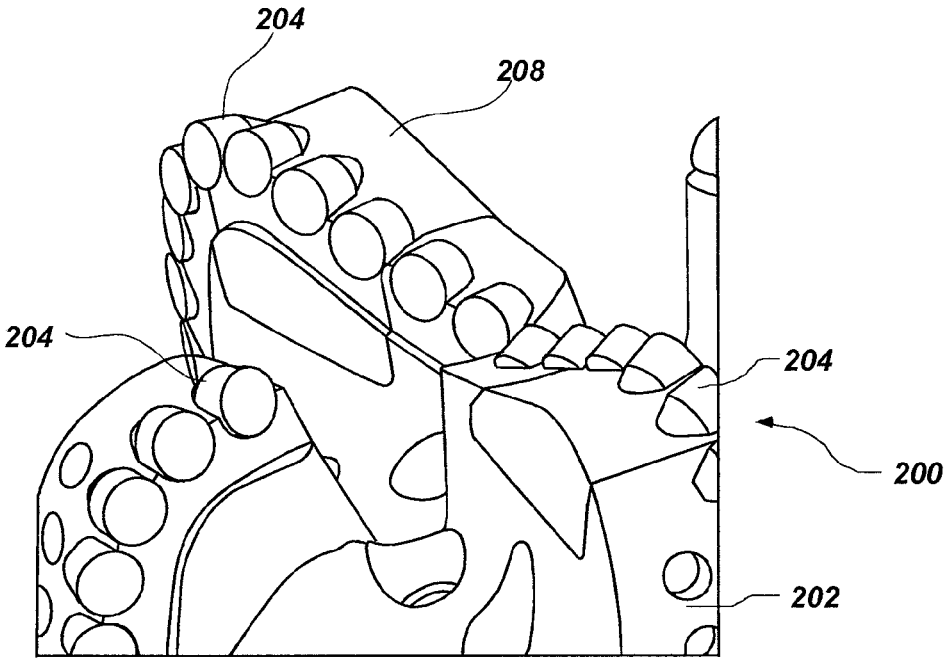
FIG. 10E shows a partial view of the PDC bit assembled with bearing blocks and cutters shown in FIGS. 10A-10D.

FIG. 9 shows a perspective view of a unitary insert bearing block 160 having two blade portions 161, 162, respectively, in accordance with a seventh embodiment of the invention. The unitary insert bearing block 160 is a unitary part for reception with a given bit frame, such that adjacent bit pockets on the bit face may respectively receive each blade portion 161 and 162 of the unitary insert bearing block 160. It is recognized that the unitary insert bearing block 160 may have more than two blade portions. The unitary insert bearing block 160 includes a first rubbing contact area 163, on blade portion 161, and a second rubbing contact area 164, on blade portion 162, for use to advantage in accordance with the invention as mentioned above.

FIGS. 10A-10E show an eighth embodiment of the invention that respectively incorporate attributes and details described in the other embodiments of the invention given herein. Specifically, as shown in FIGS. 10A-10E, a PDC bit 200 includes a bit frame 202, cutters 204, cutter pockets 205, bearing blocks 206, 208, and blade pockets 210, 212. Bearing blocks 206, 208 are located in respective blade pockets 210, 212 in the cone-nose region of the bit frame 202. The bearing blocks 206, 208 may each be located in other regions of the bit frame 202 other than the cone or cone-nose region as illustrated.

Figure 11A:
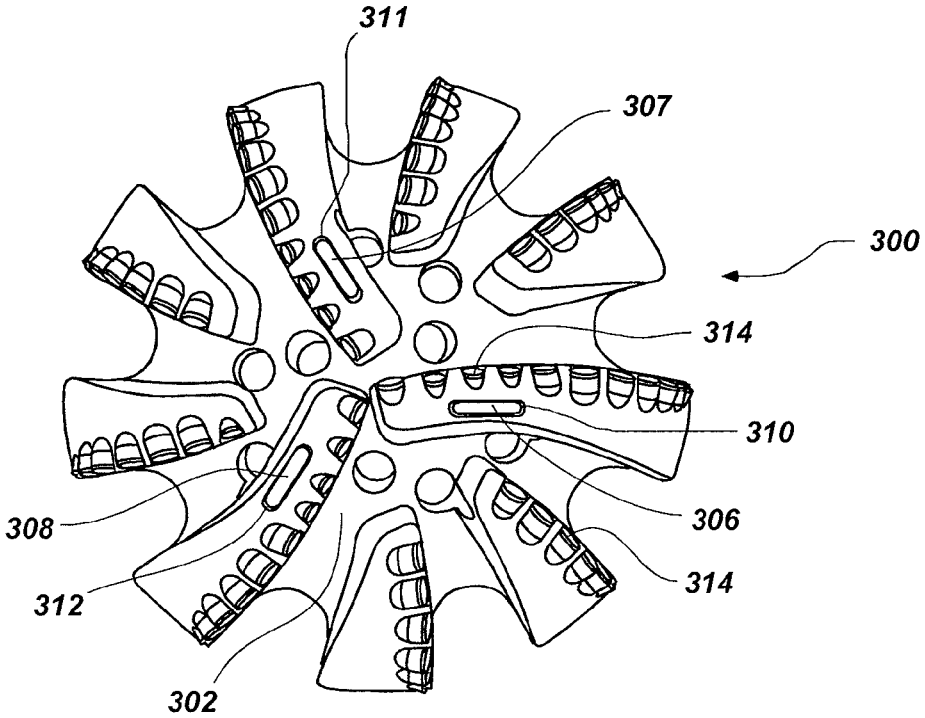
FIG. 11A shows a PDC bit having attached bearing blocks in blade pockets in accordance with a ninth embodiment of the invention.
Figure 11B:
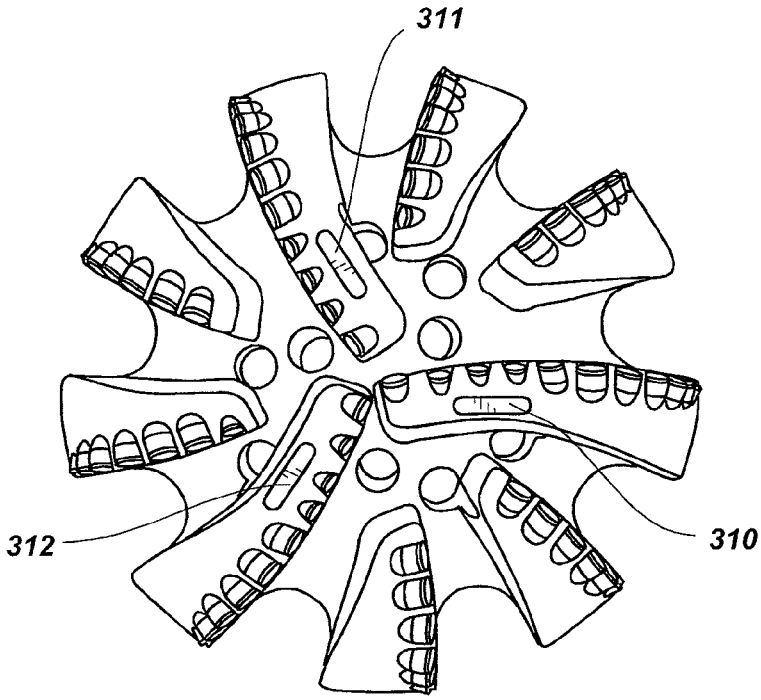
FIGS. 11B-11D show additional views of the bearing blocks and the blade pockets shown in FIG. 11A.
Figure 11C:
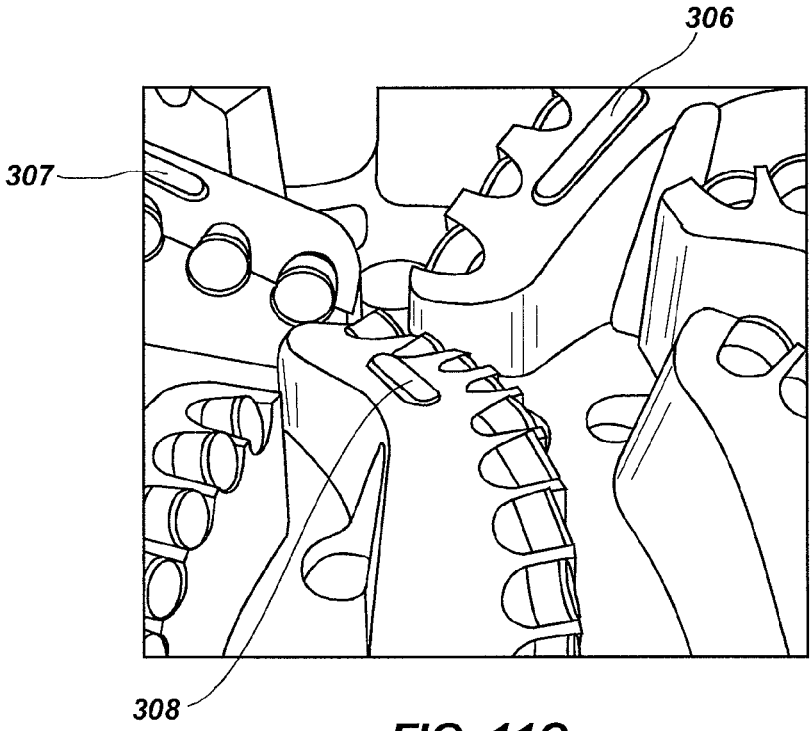
Figure 11D:
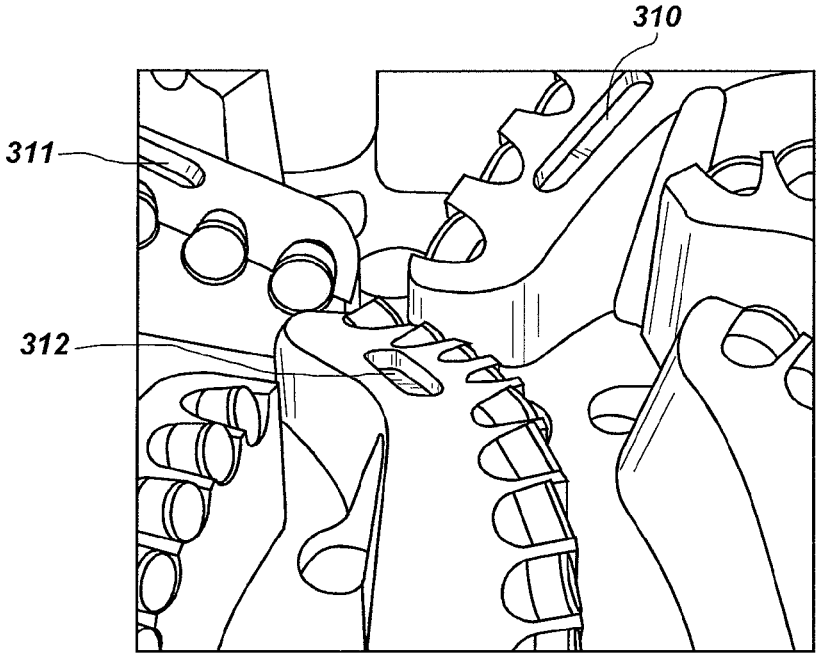

FIGS. 11A-11E show a ninth embodiment of the invention that respectively incorporate attributes and details described in the other embodiments of the invention given herein. Specifically, FIG. 11A shows a PDC bit 300 having attached bearing blocks 306, 307, 308 in blade pockets 310, 311, 312. FIGS. 11B-11D shows additional views of bearing blocks 306, 307, 308 and blade pockets 310, 311, 312 shown in FIG. 11A. Bearing blocks 306, 307, 308 are located in respective blade pockets, or receptacles, 310, 311, 312 substantially toward the cone-nose region of the bit frame 302. It is to be recognized that bearing blocks 306, 307, 308 may be located in regions of the PDC bit 300 other than illustrated.

Figure 11E:
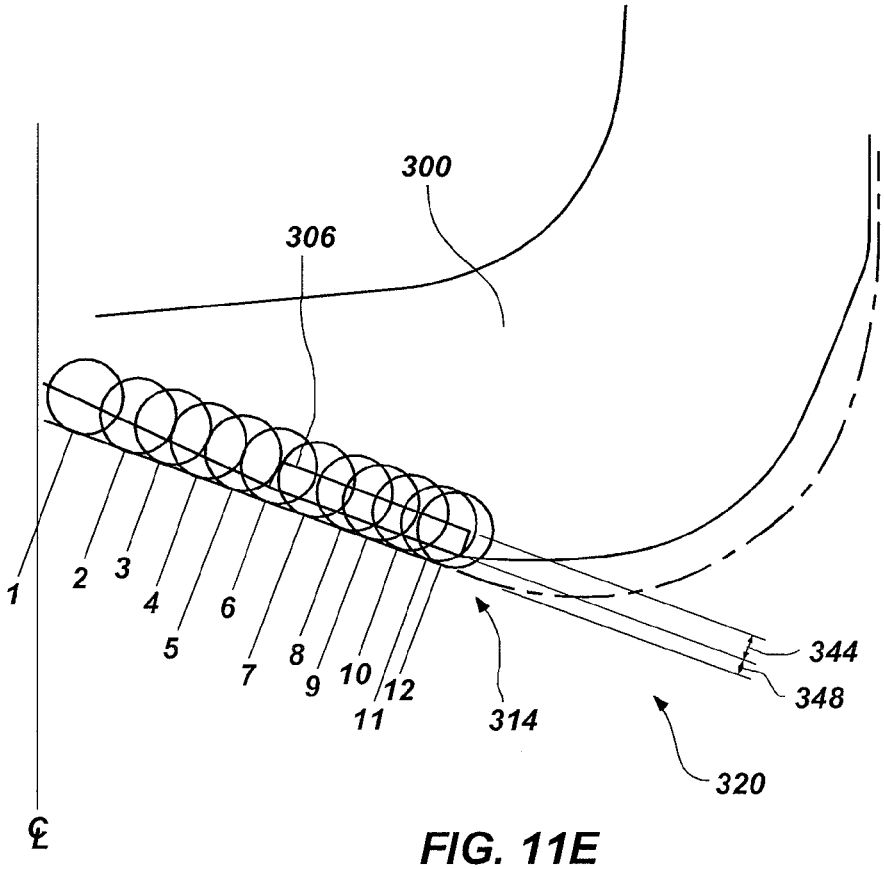
FIG. 11E shows a partial schematic side sectional view illustrating a superimposed cutter profile in accordance with one of the bearing blocks of the ninth embodiment of the invention.

FIG. 11E shows a partial schematic side sectional view illustrating a superimposed cutter profile 320 in accordance with the ninth embodiment of the invention. The cutter profile 320 shows the thickness 344 of block 306 which, when disposed in the receptacle 310 of the bit 300 shown in FIG. 11A, provides a target depth of cut (TDOC) 348 for specific cutters 314. Design criteria for TDOC for a given bit size, profile, cutter number, cutter size and cutter exposure is understood by a person having skill in the art and thus reference may be made to the incorporated references for additional information.

In summary, a bearing block according to embodiments of the invention may be configured for use with one or more blades of a bit body or frame. The inventive bearing block is designed so that it may be replaced or repaired, typically, without necessitating alteration to a standardized bit frame. The interchangeable, customizable bearing block may include one or more of a specifically selected thickness, a rubbing surface orientation and an area suitable for improving drilling performance of a bit. Bearing blocks with varying thicknesses and rubbing surface orientations and areas may be implemented. The bearing block may be located substantially in the cone region on a blade of the bit frame, in the cone/nose region or in the nose region. The interchangeable, modifiable bearing block according to embodiments of the invention brings manufacturing selectability by providing a customizable product suitable for use with a common bit frame, thus, not requiring a complex assortment of stocked bit frames. Each bearing block is selectably insertable into a bit frame, allowing a bit to be customized or adapted for different drilling applications, including difficult formations, or for different drilling systems. Also, by providing a bearing block that is selectively connectable to a bit frame, different cutting characteristics may be advantageously obtained without affecting or requiring alteration of the bit frame. Moreover, the bearing block may be designed for specific associated cutters or sets of cutters to obtain customized cutter profiles and TDOCs, due to the ability of the bearing block with a customized profile to be connected to a common bit frame without alteration thereto.

While particular embodiments of the invention have been shown and described, numerous variations and alternate embodiments will occur to those skilled in the art. Accordingly, it is intended that the invention only be limited in terms of the appended claims.

What is claimed is:

1. A rotary drill bit assembly for subterranean drilling, comprising:

a bit frame comprising a plurality of blades, a plurality of cutters carried by each of the plurality of blades, and at least one receptacle configured as a socket in an axially leading face of at least one blade of the plurality located behind at least some of the plurality of cutters carried by the at least one blade; and a bearing block received within the socket with at least a portion thereof protruding above the axially leading face of the at least one blade, the bearing block comprising a body including an interface structure in substantially complementary engagement with surfaces of the at least one receptacle and comprising a circumferential body side wall and a support surface, and the at least a portion protruding above the axially leading face of the at least one blade comprises a rubbing surface configured with at least one rubbing area for contacting a subterranean formation during drilling.

2. The rotary drill bit assembly of claim 1, wherein the at least one receptacle is located within a cone of the bit frame.

3. The rotary drill bit assembly of claim 1, wherein the at least one rubbing area is configured as one of flat, tilted and convex.

4. The rotary drill bit assembly of claim 1, wherein the at least one rubbing area comprises a plurality of rubbing areas.

5. The rotary drill bit assembly of claim 4, wherein each of the plurality of rubbing areas comprises at least one of a different body thickness, a different surface area and a different configuration.

6. The rotary drill bit assembly of claim 1, further comprising one or more wear-resistant elements on the at least one rubbing area.

7. The rotary drill bit assembly of claim 6, wherein the one or more wear-resistant elements is selected from the group consisting of tungsten carbide bricks, tungsten carbide discs, natural diamond, thermally stable polycrystalline diamond, diamond grit, diamond film and cubic boron nitride.

8. The rotary drill bit assembly of claim 1, further comprising an attachment orientation feature on the body and a complementary feature on the at least one blade.

9. The rotary drill bit assembly of claim 8, wherein the attachment orientation feature comprises a shape of at least a portion of the interface structure.

10. The rotary drill bit assembly of claim 1, wherein the interface structure is configured in the substantially complementary engagement with at least one surface of the at least one receptacle to provide a low stress interface therewith.

11. The rotary drill bit assembly of claim 1, wherein the bearing block comprises a tungsten carbide material.

12. The rotary drill bit assembly of claim 1, wherein the bearing block comprises a composite material.

13. The rotary drill bit assembly of claim 12, wherein the composite material comprises a superabrasive substantially comprising the at least one rubbing area, and a tungsten carbide layer substantially comprising the interface structure.

14. The rotary drill bit assembly of claim 1, wherein the interface structure of the bearing block is secured at least partially within the socket by interference fit.

15. A rotary drill bit assembly for subterranean drilling, comprising:

a bit frame comprising a plurality of blades, a plurality of cutters disposed on the plurality of blades, and at least one receptacle located in at least one blade of the plurality; and a bearing block secured at least partially within the at least one receptacle, the bearing block comprising a body including an interface structure in substantially complementary engagement with surfaces of the at least one receptacle and comprising at least one body side wall and a support surface, and further including a rubbing surface comprising at least one rubbing area for contacting a subterranean formation during drilling;

the bearing block further comprising one or more cutter pockets located proximate a rotationally leading side of the body as mounted to the bit frame.

16. The rotary drill bit assembly of claim 15, wherein the one or more cutter pockets are located substantially on the rubbing surface and extend into the rotationally leading side.

17. The rotary drill bit assembly of claim 15, further comprising one or more target depth of cuts, each target depth of cut determined by the distance between the at least one rubbing area and an outermost edge of a cutting face of a cutter as disposed in the one or more cutter pockets.

18. The rotary drill bit assembly of claim 15, further comprising one or more additional cutters, each of the one or more additional cutters partially received in one of the cutter pockets.

19. The rotary drill bit assembly of claim 18, wherein the one or more additional cutters comprise PDC polycrystalline diamond compact cutters.

20. The rotary drill bit assembly of claim 15, wherein the rubbing surface includes a body thickness for the at least one rubbing area.

21. The rotary drill bit assembly of claim 15, wherein the at least one rubbing area is configured as one of flat, tilted and convex.

22. The rotary drill bit assembly of claim 15, wherein the at least one rubbing area comprises a plurality of rubbing areas.

23. The rotary drill bit assembly of claim 22, wherein each of the plurality of rubbing areas comprises at least one of a different body thickness, a different surface area and a different configuration.

24. The rotary drill bit assembly of claim 15, wherein the bearing block comprises a tungsten carbide material.

25. The rotary drill bit assembly of claim 24, wherein the bearing block comprises a composite material.

26. The rotary drill bit assembly of claim 25, wherein the composite material comprises a superabrasive substantially comprising the at least one rubbing area, and a tungsten carbide layer substantially comprising the interface structure.

27. The rotary drill bit assembly of claim 15, wherein the interface structure of the bearing block is secured at least partially within the at least one receptacle by interference fit.

28. The rotary drill bit assembly of claim 15, further comprising one or more wear-resistant elements on the at least one rubbing area.

29. The rotary drill bit assembly of claim 28, wherein the one or more wear-resistant elements is selected from the group consisting of tungsten carbide bricks, tungsten carbide discs, natural diamond, thermally stable polycrystalline diamond, diamond grit, diamond film and cubic boron nitride.

30. The rotary drill bit assembly of claim 15, further comprising an attachment orientation feature on the body.

31. The rotary drill bit assembly of claim 30, wherein the attachment orientation feature comprises a shape of at least a portion of the interface structure.

32. The rotary drill bit assembly of claim 15, wherein the interface structure is configured in the substantially complementary engagement with at least one surface of the at least one receptacle to provide a low stress interface therewith.

33. The rotary drill bit assembly of claim 15, wherein the at least one receptacle is located within a cone of the bit frame.

34. A rotary drill bit assembly for subterranean drilling, comprising:

a bit frame comprising a plurality of blades, a plurality of cutters disposed on each of the plurality of blades, at least one receptacle located in at least one blade of the plurality of blades and at least another receptacle located in another blade of the plurality of blades; and a bearing block secured at least partially within the at least one receptacle, and at least another bearing block secured at least partially within the at least another receptacle, each bearing block comprising a body including an interface structure in substantially complementary engagement with surfaces of the at least one receptacle and comprising a body side wall and a support surface, and a rubbing surface comprising at least one rubbing area for contacting a subterranean formation during drilling;

wherein the bearing block and the at least another bearing block are mutually joined proximate radially inner ends thereof.

35. The rotary drill bit assembly of claim 34, wherein the bearing block and the at least another bearing block each further comprise one or more cutter pockets located proximate a rotationally leading side of the body as mounted to the bit frame.

36. The rotary drill bit assembly of claim 35, wherein the one or more cutter pockets are located substantially on the rubbing surface and extend into the rotationally leading side.

37. The rotary drill bit assembly of claim 35, further comprising one or more target depth of cuts, each target depth of cut determined by the distance between the at least one rubbing area and an outermost edge of a cutting face of a cutter as disposed in the one or more cutter pockets.

38. The rotary drill bit assembly of claim 35, further comprising one or more additional cutters, each of the one or more additional cutters partially received in one of the one or more cutter pockets.

39. The rotary drill bit assembly of claim 38, wherein the one or more additional cutters comprise polycrystalline diamond compact cutters.

40. The rotary drill bit assembly of claim 34, wherein the rubbing surface includes a body thickness for the at least one rubbing area.

41. The rotary drill bit assembly of claim 34, wherein the at least one rubbing area is configured as one of flat, tilted and convex.

42. The rotary drill bit assembly of claim 34, wherein the at least one rubbing area comprises a plurality of rubbing areas.

43. The rotary drill bit assembly of claim 42, wherein each of the plurality of rubbing areas comprises at least one of a different body thickness, a different surface area and a different configuration.

44. The rotary drill bit assembly of claim 34, wherein the bearing block and the at least another bearing block each comprise a tungsten carbide material.

45. The rotary drill bit assembly of claim 34, wherein the bearing block and the at least another bearing block each comprise a composite material.

46. The rotary drill bit assembly of claim 45, wherein the composite material is a superabrasive substantially comprising the at least one rubbing area, and a tungsten carbide layer substantially comprising the interface structure.

47. The rotary drill bit assembly of claim 34, wherein the interface structure of the bearing block is secured at least partially within the at least one receptacle by interference fit and the interface structure of the at least another bearing block is secured at least partially within the at least another receptacle by interference fit.

48. The rotary drill bit assembly of claim 34, further comprising one or more wear-resistant elements on the at least one rubbing area.

49. The rotary drill bit assembly of claim 48, wherein the one or more wear-resistant elements is selected from the group consisting of tungsten carbide bricks, tungsten carbide discs, natural diamond, thermally stable polycrystalline diamond, diamond grit, diamond film and cubic boron nitride.

50. The rotary drill bit assembly of claim 34, further comprising an attachment orientation feature on the body of each of the bearing block and the at least another bearing block.

51. The rotary drill bit assembly of claim 50, wherein the attachment orientation features comprises a shape of at least a portion of each of the interface structures.

52. The rotary drill bit assembly of claim 34, wherein the interface structure of the bearing block is configured in the substantially complementary engagement with at least one surface of the at least one receptacle to provide a low stress interface therewith and the interface structure of the at least another bearing block is configured in the substantially complementary engagement with at least one surface of the at least another receptacle to provide a low stress interface therewith.

* * * * *

UNITED STATES PATENT AND TRADEMARK OFFICE

CERTIFICATE OF CORRECTION

PATENT NO. : 8,459,382 B2
APPLICATION NO. : 12/901107
DATED : June 11, 2013
INVENTOR(S) : Enis Aliko and Thorsten Schwefe It is certified that error appears in the above-identified patent and that said Letters Patent is hereby corrected as shown below:

On the title page:

In ITEM (56) References Cited:
OTHER PUBLICATIONS
Page 2, 2nd column, 3rd line of the
15th entry (line 69), change "United Stated" to --United States--

In ITEM (56) References Cited:
OTHER PUBLICATIONS
Page 2, 2nd column, 3rd line of the
17th entry (line 75), change "Stated District" to --States District--

In ITEM (56) References Cited:
OTHER PUBLICATIONS
Page 2, 2nd column, 4th line of the
17th entry (line 76), change "redacted)ark" to --redacted) Mark--

In ITEM (56) References Cited:
OTHER PUBLICATIONS
Page 3, 1st column, 6th line of the
17th entry (line 2), change "United Stated" to --United States--

In ITEM (56) References Cited:
OTHER PUBLICATIONS
Page 3, 1st column, 6th line of the
18th entry (line 9), change "United Stated" to --United States--

Signed and Sealed this
Twenty-fourth Day of February, 2015

Michelle K. Lee

Michelle K. Lee
*Deputy Director of the United States Patent and Trademark Office*

On the title page (continued):

In ITEM (56) References Cited:
OTHER PUBLICATIONS
Page 3, 1st column, 4th line of the 19th entry (line 15), change "United Stated" to --United States--

In ITEM (56) References Cited:
OTHER PUBLICATIONS
Page 3, 2nd column, 4th line of the 20th entry (line 2), change "Petition Unde R 37" to --Petition Under R 37--

In ITEM (56) References Cited:
OTHER PUBLICATIONS
Page 3, 2nd column, 4th line of the 21st entry (line 7), change "Petition Unde R 37" to --Petition Under R 37--

In ITEM (56) References Cited:
OTHER PUBLICATIONS
Page 3, 2nd column, 2nd line of the 22nd entry (line 10), change "Easter District" to --Eastern District--

In ITEM (56) References Cited:
OTHER PUBLICATIONS
Page 3, 2nd column, 2nd line of the 23rd entry (line 13), change "Easter District" to --Eastern District--